US006196005B1

(12) United States Patent
Stautner

(10) Patent No.: US 6,196,005 B1
(45) Date of Patent: Mar. 6, 2001

(54) CRYOSTAT SYSTEMS

(75) Inventor: Wolfgang Stautner, Pottle Close (GB)

(73) Assignee: Oxford Magnet Technology Limited, Oxon (GB)

( * ) Notice: Subject to any disclaimer, the term of this patent is extended or adjusted under 35 U.S.C. 154(b) by 0 days.

(21) Appl. No.: 09/159,500

(22) Filed: Sep. 23, 1998

(30) Foreign Application Priority Data

Sep. 30, 1997 (GB) ..... 9720637

(51) Int. Cl.[7] ..... F25B 9/00
(52) U.S. Cl. ..... 62/6
(58) Field of Search ..... 62/6, 51.1

(56) References Cited

U.S. PATENT DOCUMENTS 5,018,359 * 5/1991 Horikawa et al. ..... 62/51.1
5,339,650 * 8/1994 Hakamada et al. ..... 62/51.1
5,744,959 * 4/1998 Jeker et al. ..... 324/319

FOREIGN PATENT DOCUMENTS 2 286 450 8/1995 (GB) .

* cited by examiner

*Primary Examiner*—Corrine McDermott
*Assistant Examiner*—Malik N. Drake
(74) *Attorney, Agent, or Firm*—Evenson, McKeown, Edwards & Lenahan, P.L.L.C.

(57) ABSTRACT

Cryostat systems comprise first and second liquid interconnected helium baths, and a magnet structure which is immersed in one of the baths. The liquid helium is cooled by means of a pumped refrigeration means. The pumped refrigeration means is replaced with a pulse tube refrigerator which can be located directly within the two baths. The pulse tube refrigerator has a "cold finger" having cold and warm ends. The cold end extracts into the bath housing the coil structure and has heat exchange connected thereto. The pulse tube refrigerator can also serve to cool the radiation shields.

13 Claims, 4 Drawing Sheets

CRYOSTAT SYSTEMS

BACKGROUND AND SUMMARY OF THE INVENTION

The present invention relates to cryostat systems in the field of NMR spectroscopy and related experimental fields of application but not limited thereto, and in particular to high-field NMR systems having pulse tube coolers operating in the sub-helium temperature range.

This type of spectroscopy is presently one of the most exact analytic methods when looking at highly complex chemical and biological molecules and makes it possible to reveal a variety of findings which have not been possible up to now.

More specifically, the present invention relates to the cryostat of NMR systems, and in particular aims directly at high-field NMR applications. The most recent commercially available high-field magnet systems show a proton resonance frequency $V_R$ of about 750 MHz, which corresponds to a field of about 17.63 Tesla. For certain applications higher fields are required, e.g. 900 MHz which corresponds to 21.1 T and even higher fields to reach the GigaHertz region. Spectroscopy requires high field strength and low field drift, usually in the region of $10^{-8}$ per hour or less of the central field strength. Both of these may be achieved by using present-day standard $Nb_3Sn$ or NbTi wires or tapes, in combination with HTC wire technology for 20 Tesla systems, as proposed by Komarek in Hochstromanwendung der Supraleitung, High-power applications in Superconductivity, Teubner Studienbucher, page 93 and 94, and by sub-cooling the helium bath in which the magnet is immersed. This sub-cooling of the helium bath is done by external means, most often by pumping the bath down to the required temperature by means of a pump assembly. The definition used herein for sub-cooling, actually refers to temperatures in the range below 4.2 K, in particular around the lambda transition point and down to 1.8 K in case large pumps are being used. Because of the low vapour pressure and film flow of helium any further reduction in temperature is difficult to achieve. At a saturated vapour pressure of about 50 mbar a transition occurs at $T\lambda=2.172$ K which is termed the lambda point. At this point, liquid helium I and liquid helium II are separated by the common boundary phase, called the lambda line. It is also a well known fact that when pumping the system down to 2.172 K helium creep may be detected in the vicinity of the heat exchanging surface due to the change in physical properties of liquid helium as a result of reducing the vapour pressure.

It is well known in high-field NMR systems that pumping down a helium bath uses both open and closed loop control systems technology attached to the cryostat. Pumping down means reducing the overall pressure of the helium bath down to 60 mbar or lower.

A typical high-field system is described in GB patent number 2286450A.

In order to run the system unattended, the control of the pump assembly maintaining the sub-cooled temperature in the helium bath as well as the feedback control of the flow rate of the pumped helium gas controlling the helium bath temperature must be monitored continuously, which in turn means additional costs for investment and maintenance. If the pumping system fails, the helium bath and magnet will begin warming towards 4.2 K, and the magnet will quench. In order to prevent this happening, and ensure continuous operation, equipment redundancy is required which also means additional costs. A further shortcoming of such a pumped system could be the pipe work of the pumping system connected to the cryostat, as this could be a permanent source of vibration transmitted to the internal components of the cryostat, e.g. the radiation shields and other parts receptive of vibration. A further shortcoming of such a pumped system could be the increased penetration of ice into the system due to the under pressure. This could cause severe problems as ice could gradually build up within the turrets, e.g. starting to build up at electrical connections routed from the coil up to the tube inlet and into the neck tube, and virtually block the neck tubes without the user's knowledge. Thus, a pumped system also needs permanent inspection, electronic monitoring and maintenance.

Reducing the gas pressure in the vessel housing the magnet sections also means that a control mechanism has to be introduced to the 2.2 K stage. This control mechanism usually is a special valve, probably a needle valve with which extremely low flow rates can be achieved. Because of the small flow rate, which in fact is termed 'leakage flow rate', this leakage flow has to be controlled by setting it from the accessible warm end of the valve spindle. Care has to be taken so that ice will not penetrate into the system. Due to the under pressure, i.e. suction process within the valve system, provision has to be made to safeguard against particles penetrating the valve seat which would make it impossible to set the desired flow rate. Also as has been mentioned above, this system could be subject to icing problems which are most likely to occur during warm-up and cool-down or when ice would enter from the top vessel, which in turn makes it difficult, if not impossible to adjust the flow rate. Furthermore, this type of precision control elements are expensive and add to the overall costs of the NMR system.

In order to achieve a stable temperature at the lambda temperature level, approximately 40% of the enthalpy of the liquid helium has to be withdrawn out of the low helium reservoir and has to be added to the total boil-off in a pumped system. Hence, a pumped system inherently shows an increased boil-off of liquid helium and added overall running and maintenance costs which are higher than with 4.2 K dewars of comparable size.

In summary, a sub-cooled system presents a challenge in that the overall structure and layout is more complicated and subject to failure than cryostats operating at the normal boiling point of liquid helium.

It has not previously been feasible to introduce a piston-driven cryo-cooler into a NMR system, because of the induced vibration to the overall system, to the magnet which makes it impossible to attain a good NMR signal without distortion and also because of the non-availability of low-temperature cryo-coolers in general for this temperature region.

Meanwhile, the current technology in cryo-coolers has considerably advanced and it is possible to achieve temperatures as low as 2.13 K even with piston-less systems. This would mean, as has been emphasised above, that this temperature region could be achieved without pumping and the bath actually behaves just like any other 4.2 K system.

A cooler which gives a cooling capacity at lambda temperatures will be called a lambda cooler in the following description.

Therefore, the aim of the present invention is to provide a non-pumped mechanical cooling system to a high-field NMR system.

According to the present invention there is provided a cryostat system comprising means defining first and second volumes of cooling liquid, a superconducting magnetic coil structure immersed within one of said volumes of cooling liquid, and cooling means for maintaining an operating temperature of the coil structure in the sub-helium temperature range, characterised in that said cooling means is a pulse tube refrigerator which extends into said first and second volumes of cooling liquid.

The pulse tube refrigerator includes a cold end and a heat exchanger connected thereto which extends into the volume of liquid in which the coil structure is immersed.

The pulse tube refrigerator can conveniently be incorporated in an existing neck tube to reduce the boil-off of cooling liquid.

The warm end of the pulse tube refrigerator may be pre-cooled by either a further pulse tube refrigerator operating at 80 K, or by being directly thermally linked to the liquid nitrogen temperature level and/or at the lower temperature of the radiation shields at the internal linking position in the turnet.

The pulse tube refrigerator may also be used to support and cool the radiation shields.

The pulse tube refrigerator, if it is designed to be rigid, may also be used both to support and cool the radiation shields in the case of a multistage cooler, and simultaneously to support the neck tube, thus suspending the magnet system.

Other objects, advantages and novel features of the present invention will become apparent from the following detailed description of the invention when considered in conjunction with the accompanying drawings.

BRIEF DESCRIPTION OF THE DRAWINGS

An embodiment of the present invention will now be described with reference to the accompanying drawing, in which.

DETAILED DESCRIPTION OF THE DRAWINGS

Figure 1:
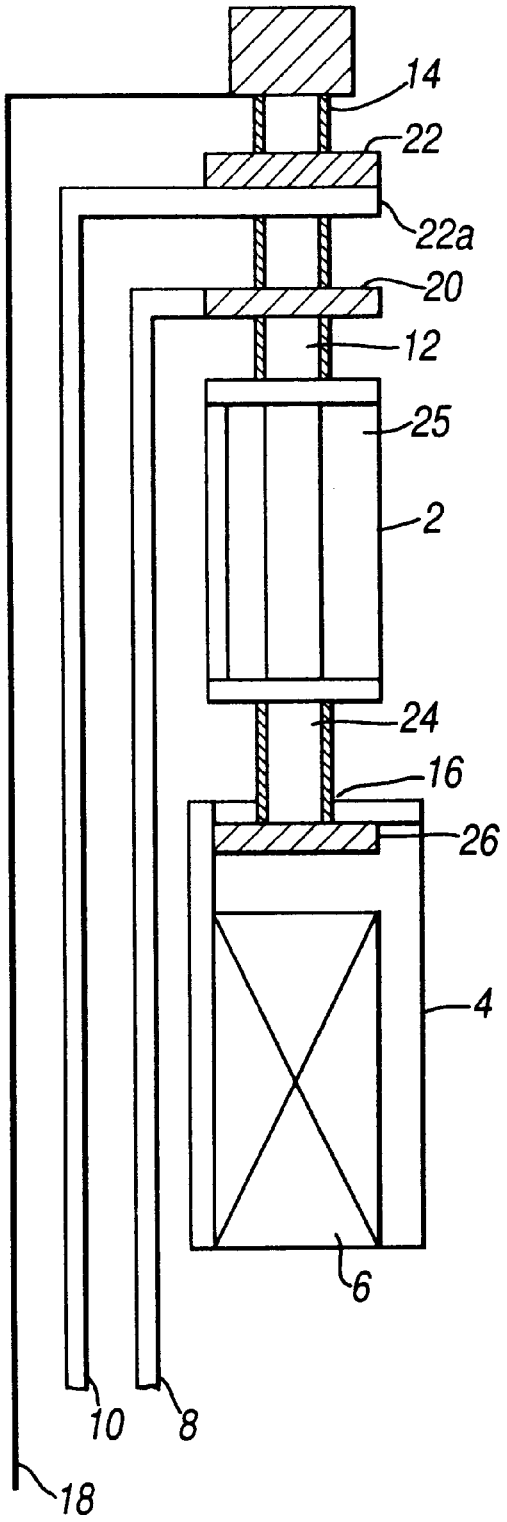
FIG. 1 shows part of an NMR system incorporating a pulse tube refrigerator.

FIG. 1 shows part of a high-field NMR system having a first upper helium bath 2 which is typically at a temperature of 4.2 K, and a second lower helium bath 4, which is typically at a temperature of 1.8–2.5 K, thus defining first and second volumes of cooling liquid. The lower helium bath has a superconducting magnet coil assembly 6 immersed therein. Two radiation shields 8, 10 are shown. It will be appreciated that the NMR system so far described is well known and is described in the above mentioned GB Patent which also describes the manner in which the upper and lower baths 2, 4 are interconnected.

The present invention seeks to improve upon the system described in the above mentioned patent application, by replacing the cooling arrangement described therein by a pulse tube refrigerator. The pulse tube refrigerator is shown in FIG. 1 comprising a cold finger or cooling rod 12 having a warm end 14 and a cold end 16. The cooling rod extends through the upper bath 2 and into the lower bath 4 where it is connected to a heat exchanger 26. The cooling rod 12 being inserted is also thermally linked to one or several radiation shields 8, 10 at points 20, 22 and serves to cool the radiation shields. An outer vacuum can 18 surrounds the shield 10.

The warm end 14 can be pre-cooled by an 80 K pulse tube refrigerator which can also serve as a support member for the radiation shields at points 20, 22 and as a means of cooling the radiation shields.

Alternatively, position 22 may be cooled by a liquid nitrogen vessel connected directly to it, which replaces the radiation shield 10.

Although two baths have been discussed above, the NMR system could have a single bath having internal separation means providing the first and second volumes of cooling liquid. The separation means could be a thick, thin-walled hollow disk, or an evacuated disk or a disk made from thermally low conducting material such as nylon or carbon fibre composites.

As mentioned above, if the pulse tube is designed to be rigid, this separating disk can be fixed onto the cooler itself if permanent fixture of the cooler is envisaged.

The operation of a so-called pulse tube refrigerator will now be described. Pulse tube refrigerators have now reached the lambda temperature line of helium. A typical pulse tube configuration for lambda temperature is discussed in a publication by G Thummes, S Bender and C Heiden, entitled 'Approaching the $4_{He}$ lambda line with a liquid nitrogen pre-cooled two stage pulse tube refrigerator', published in Cryogenics 1996, Vol 36, Number 9, at pages 709–711. The pulse tube design described therein uses a pre-cooled system using liquid nitrogen as a means for pre-cooling the lambda cooler. This pre-cooling could also be facilitated by means of an additional two-stage or single-stage pulse tube cooler which would cool the shield assembly whilst the cold finger attached to its latter final stage would cool and maintain the helium bath lambda temperature.

As described above, the lambda cooler essentially comprises a simple hollow circular tube 12 and a regenerator tube being the so-called 'cold finger' having a heat exchanger 26 attached to its cold stage and providing a very efficient means of maintaining the liquid helium bath at a constant temperature. The various geometries of arranging the regenerator and pulse tubes are described in an article by R N Richardson, entitled 'Development of a practical pulse tube refrigerator: coaxial designs and the influence of viscosity', in Cryogenics 1988 Vol. 28, August.

Cool down of a typical volume of helium of 100 liters from 4.2K to 2K could be achieved within two to three days, if the cooler is designed to give a cooling capacity of 0.2 W at 2K. As more powerful cooling capacity will become available this cool down time could further be reduced. If desired a retrofit pump line could be inserted into one turret to achieve faster cool down rates.

It is a further well established fact that these types of immersed bath-cooled high-field systems show a remarkably stable performance once the bath is cooled down to the specified set temperature. Therefore, fitting an appropriate heat exchanger to the cold finger which is a commercially available aluminium finned system, or any other heat exchanger geometry common in engineering, provides sufficient means for heat transfer to the helium bath in order to maintain the working temperature of the helium bath. Temperature fluctuations as a result of different operating conditions, can easily be accounted for even when only a small power is available from the pulse tube.

This small amount of power cooling can take account of temperature fluctuations caused by density flow variations in the surrounding liquid helium.

However, a temperature lower than the lambda temperature should be avoided to minimise helium creep effects which are difficult to control from the engineering point of view. Thermal stratification is the same as with a pumped system and does not impose an additional difficulty.

One advantage of the present invention is that due to the absence of any under pressure to maintain the specified temperature, icing problems are reduced to a minimum and are therefore much easier to handle at the customer's site, and this improves overall safety.

Moreover, the present invention as described in FIG. 1, emphasises the fact, that, in the most unlikely event that the cooler fails to work, a replacement could be easily installed by withdrawing the cold finger 12 and retrofitting it with another. The pulse tube could be designed such that if the regenerator and pulse tubes are arranged in series, bending of the tube can be achieved or a flexible part can be introduced at the point of interconnection of the pulse tube and regenerator tube, in order to be able to comply with the installation height at the customers' site when retrofitting. Due to the high heat capacity of helium at this temperature, there is sufficient time (typically two to three days) for any replacement of the cooler should it ever become necessary.

Another advantage of a system as shown in FIG. 1 is the ease of installation of the cooling system. Preferably such high-field systems are configured as double vessel systems, e.g. a double tank dewar. That means the pulse tube refrigerator would only have to be fixed and fitted at the top flange of the cryostat's outer vacuum case, whilst the other part extending to the lower helium bath level, with the superconducting magnet 6 immersed at for example, 2.23 K, would only have to be guided within the tubes connecting both helium baths 2, 4 leaving a small annulus. No permanent fixture is necessary or need for a particular position. This eases fitting or retrofitting of the cooler without having to run-down the magnet which in turn save considerable cost and time.

Furthermore, during operation, and as the cooler continues to supply cooling power at 2.2 K, the thermal gradient in the 4.2 K helium bath changes such that the 2.2 K boundary tends to extend towards the upper helium bath 2 (thermal stratification or build-up of layers of different temperature levels), whilst simultaneously replenishment of helium towards the lower storage bath 4 is effected through various annuli connecting both vessels. A temperature gradient within the upper region of the helium bath is thus developed, and the helium bath no longer shows the temperature homogeneity which would be experienced with a pure 4.2 K bath. To some extent this is also desired in order to thermally protect the magnet. If desired this can be controlled very conveniently by reducing the cooling power of the cold head by adjusting or reducing the compressor power, or as the liquid helium 4 level decreases subject to normal boil-off, by refilling the upper helium bath 2 or by slightly heating the upper bath by means of a resistor.

The tube 12 most probably has a diameter ranging from 5 to 20 mm, and in the event of having to withdraw the cold finger from the lower helium bath 4, a small volume corresponding to the size of the cold finger opens up between both helium baths 2, 4 resulting in heat penetrating from 4.2 K down to 2.2 K. This heat conducted downwards is an order of magnitude higher than the total sum of the calculated annuli flow down to the lower liquid helium in bath 4.

The withdrawal of the cold finger 12 neither disturbs nor makes it impossible to maintain the functionality of the cryo system itself, as the 4.2 K helium liquid bath settles rapidly and restores the thermal gradients between both baths as well as extending the gradient to the upper helium bath which in turn safeguards against any sudden change of inflow of heat (at 4.2 K liquid helium temperature down to 2.2 K) during replacement as mentioned above.

At present the pulse tube regenerator material sometimes consists of a magnetic rare earth material. It is known that temperatures as low as 3.6 K can be obtained by using pure non-magnetic lead shot. Thus, one could either avoid the use of the magnetic regenerator material for future use or if this should prove to be not feasible, one could make provision for an appropriate magnetic shielding of the regenerator. Even shimming out this magnetic effect is feasible as this mass is tightly packed and by nature of its functionality not allowed to move in any direction within the regenerator tube, and is only a very small lumped mass which would only add to the overall magnetic inventory (e.g. screws and other slightly magnetic items). In any case, screening of the lumped mass is possible.

The lambda pulse tube cooler thus described could be used for liquefaction of the liquid helium bath, this helium bath temperature being defined as the normal boiling temperature of liquid helium, namely 4.2 K, and targeted specifically for NMR high-field systems where there is a need for a long term, continuous operation.

The lambda cooler therefore could also be used most conveniently for bath-cooled 4.2 K spectrometer systems. The invention may also be used in a different range of applications, namely the mid-range high-field magnets covering the 300 to 700 MHz systems.

The lambda cooler may conveniently be located in the neck tube of NMR systems, thereby eliminating the boil-off of the liquid helium, and thus providing the customer with a zero-loss system requiring no handling of liquids and ensuring continuous operation.

Although the boil-off is low in present day commercial systems, the invention reduces the handling of liquids and would keep the helium level constant without the need for refilling or re-shimming the magnet and thus substantially extends the continuous period of operation of such a system in that the need for filling and the interruption caused by it no longer exists.

It is also possible to shut off the helium vessel completely from the environment, thus creating a stable autonomous cryo-environment which is not affected by the external sources, e.g. as in a pumped system. Generally, spectrometer systems are safeguarded against any penetration of air by maintaining a certain over pressure in the cryostat.

However, in case of a pumped system the helium gas in the ullage space above the helium liquid level could still interact with the outflow of helium passing through the piping system of the turrets and induce thermal oscillations, a well-known phenomenon in low-temperature technology, which in turn gives rise to a higher boil-off helium. By introducing a lambda cooler the cryostat is further simplified and unwanted thermal effects on the boil-off are thus eliminated.

Up to now the introduction of liquefiers has not been feasible, and a satisfactory NMR signal could not be obtained, due to the moving parts of the GM cooler, namely the piston, which would influence the magnetic field due to its oscillatory movement, which also indirectly introduces eddy currents in the aluminium shields, and also because of the vibration of the piston which permanently excites the shield structure.

Figure 2:
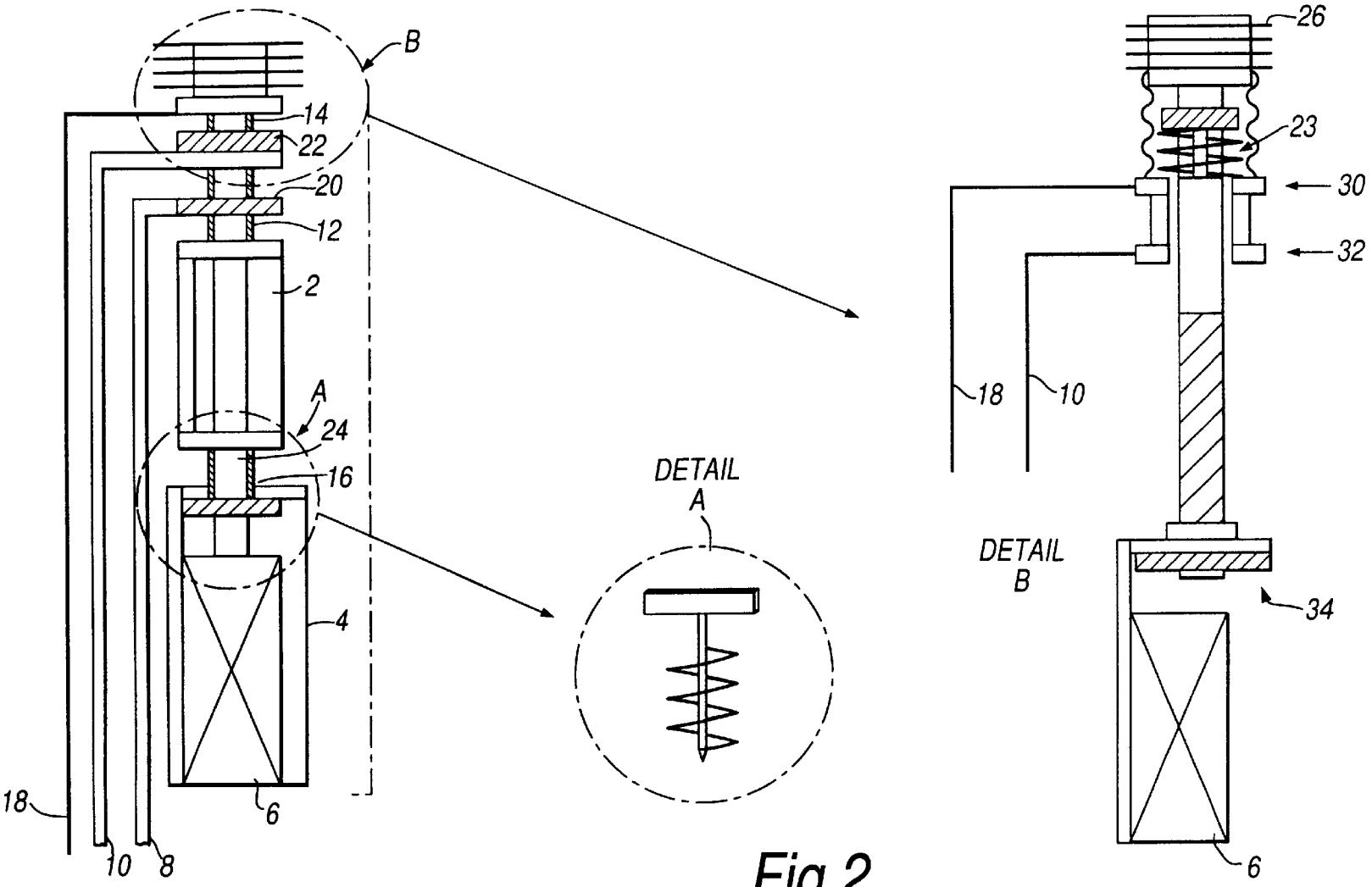
FIG. 2 shows in greater detail that part of an NMR system as shown in FIG. 1, when used as a pulse tube refrigerator cooler for the cooling of high-field magnetic systems.

Referring to FIG. 2, a lambda cooler is shown in greater detail. Like parts bear the same reference as in FIG. 1. The pulse tube refrigerator acts as a 2.2K cooler for the cooling of high-field magnetic systems. The pulse tube refrigerator is attached to a heat exchanging system as shown in detail A, thus avoiding a pumped bath. The pulse tube refrigerator may also be used as part of a suspension system if rigidly fixed and as a shield cooler. Cooling fins may be provided for the cold head. A spring system 28 extends from the cold head to the outer vacuum vessel. The outer vacuum vessel is connected at point 30. The cooler is attached at point 34.

Figure 3:
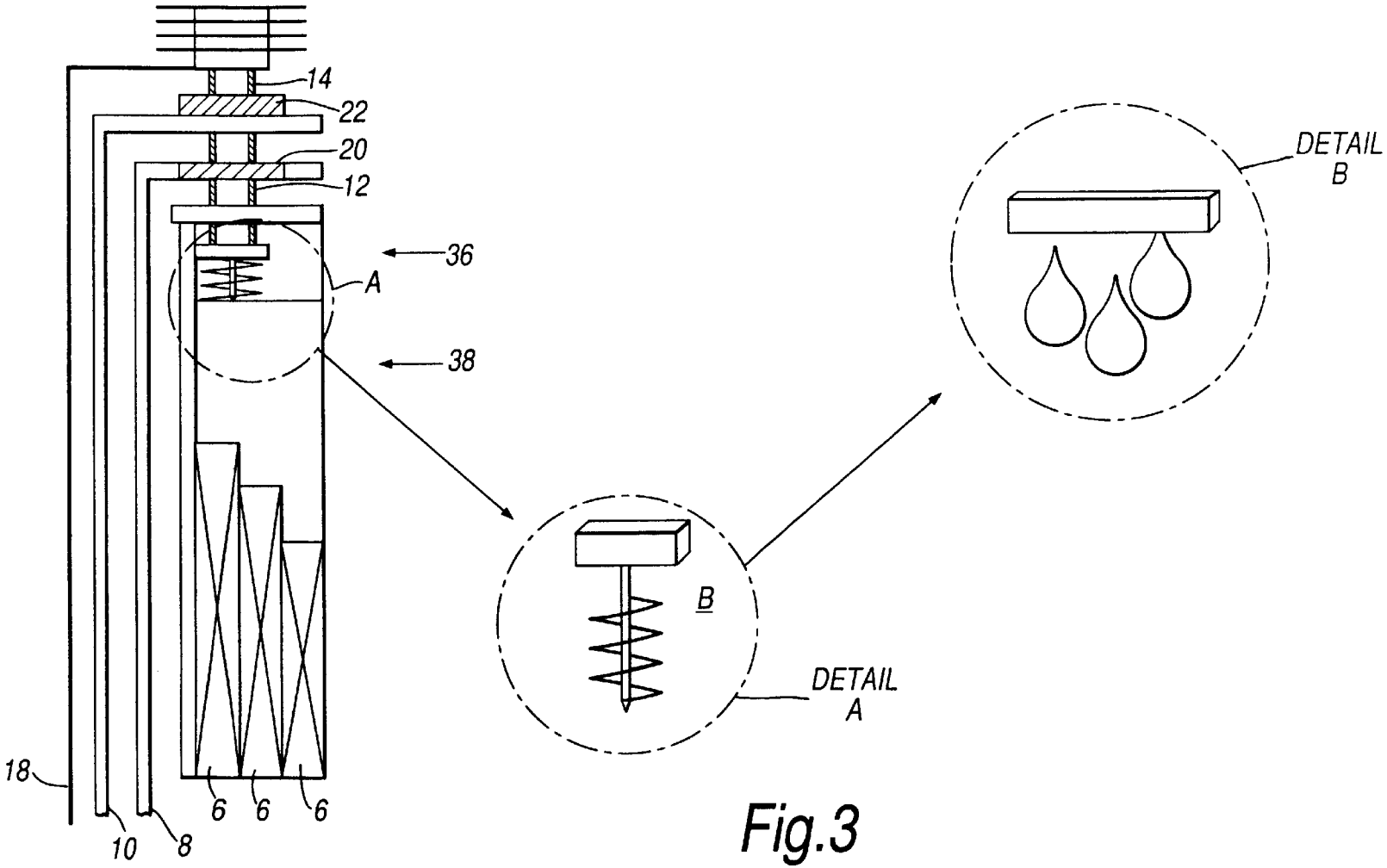
FIG. 3 shows a 4.2K cooler and liquefier for high-field NMR applications, and, FIG. 4 shows various pulse tube configurations.

Referring to FIG. 3, a 4.2K cooler and liquefier for a high-field 1. NMR system is shown. Like parts bear the same reference as in FIG. 1.

The cooler is operating in a single vessel dewar for NMR high-field magnets. The gas region is shown at point 36, and the liquid region is shown at point 38. Regions A and B are shown in greater detail, Detail A and B respectively.

Figure 4:
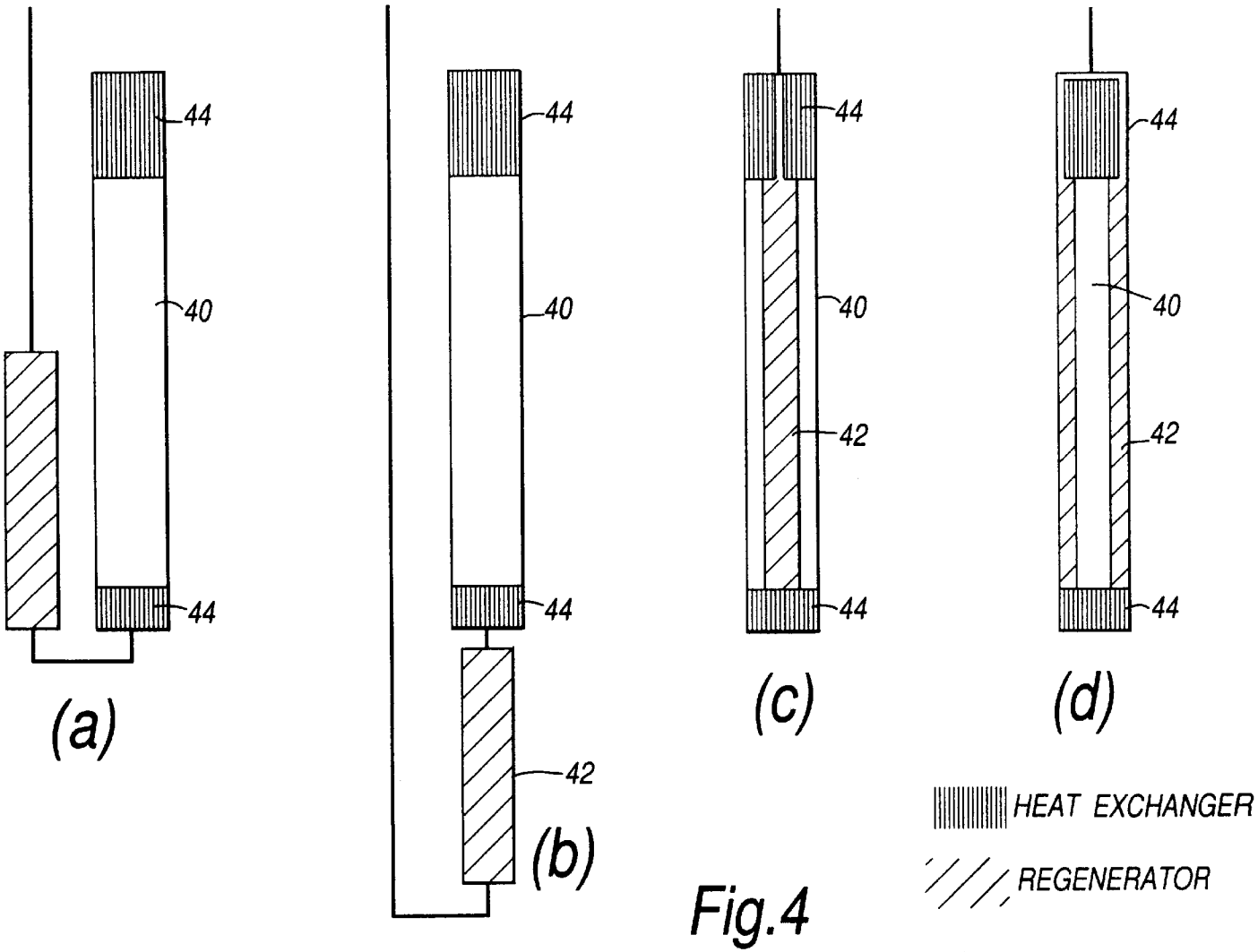

Referring to FIG. 4, this figure shows various configurations of pulse tubes 40 and regenerator tubes 42, know in the art, together with heat exchanger 44.

Any of these configurations is suitable for use with the present invention.

In the event that the pulse tube is rigidly designed to carry the thermal barrier or part of the magnet and cryostat mechanical loads, the pulse tube has to be fixed, e.g. welded, preferably at position 25 or 26, in FIG. 1. It may then be necessary to introduce a tube with one or two bellow bends at position 22 between the warm end of the pulse tube and the outer vacuum case to take into account shrinkage of the pulse tube system. If the pulse tube has to carry higher loads, the aforementioned tube could be replaced by a soft bellow and an internal Belleville spring system, which could carry the loads while at the same time allowing thermal shrinkage of the system to take place, as shown in FIG. 2. Alternatively, a section of the upper part of the tube could be made of a material with a negative thermal expansion coefficient.

However the preferred position would be to insert a soft bellows between position 22 and 22*a* whilst the pulse tube cooler is guided in the baths 2 and 4 and thermally linked to the radiation shields.

If it is not desired to have the pulse tube immersed into liquid helium in bath 2 this can be achieved by either wrapping a thermal insulation around the tube with an appropriate wall thickness, or by placing an additional tube into bath 2, permanently welded in and connecting the lower and upper plate of the vessel respectively. In this way the pulse tube shares the common vacuum of the cryostat and the longitudinal thermal gradient within the pulse tube is not affected.

The heat transfer device at position 26 could be any commercially available exchange device.

A further advantage in this design lies in the fact that the helium vessel could be of reduced length as the heat exchange surface could penetrate only up to point 24 and still drive the convection-type heat exchange process.

It will be appreciated by those skilled in the art that the present invention is limited to NMR applications but could be extended to other fields of application.

The invention can conveniently be used in NMR systems arranged to operate in the temperature range of 1 to 4.2 k.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A cryostat system comprising means defining first and second volumes of a cooling liquid, a superconducting magnet coil structure immersed within one of said volumes of cooling liquid, and cooling means for maintaining an operation temperature of the coil structure in the sub-helium temperature range, characterized in that said cooling means is a pulse tube refrigerator which extends into said first and second volumes of cooling liquid wherein the pulse tube refrigerator includes a cold end and a heat exchanger connected thereto which extends into the volume of liquid in which the coil structure is immersed.

2. A cryostat system as claimed in claim 1, wherein said pulse tube refrigerator includes a warm end, which is pre-cooled to liquid nitrogen temperature by means using a further pulse tube refrigerator.

3. A cryostat system as claimed in claim 2, including at least one radiation shield and the further pulse tube refrigerator acts as a cooler and support member for the shield.

4. A cryostat system as claimed in claim 2, wherein the pulse tube refrigerator includes a warm end which is pre-cooled by a liquid nitrogen vessel connected directly or indirectly to it.

5. A cryostat system as claimed in claim 1, having at least one neck tube in which the pulse tube refrigerator is located, thereby reducing boil-off of the cooling liquid.

6. A cryostat system as claimed in claim 5, wherein said pulse tube refrigerator includes a warm end, which is pre-cooled to liquid nitrogen temperature by means using a further pulse tube refrigerator.

7. A cryostat system comprising means defining first and second volumes of a cooling liquid, a superconducting magnet coil structure immersed within one of said volumes of cooling liquid, and cooling means for maintaining an operation temperature of the coil structure in the sub-helium temperature range, characterized in that said cooling means is a pulse tube refrigerator which extends into said first and second volumes of cooling liquid having at least one neck tube in which the pulse tube refrigerator is located, thereby reducing boil-off of the cooling liquid.

8. A cryostat system as claimed in claim 7, wherein said pulse tube refrigerator includes a warm end, which is pre-cooled to liquid nitrogen temperature by means using a further pulse tube refrigerator.

9. A cryostat system as claimed in claim 8, including at least one radiation shield and the further pulse tube refrigerator acts as a cooler and support member for the shield.

10. A cryostat system as claimed in claim 8, wherein the pulse tube refrigerator includes a warm end which is pre-cooled by a liquid nitrogen vessel connected directly or indirectly to it.

11. A cryostat system as claimed in claim 7, wherein the pulse tube refrigerator includes a warm end which is pre-cooled by a liquid nitrogen vessel connected directly or indirectly to it.

12. A cryostat system comprising means defining first and second volumes of a cooling liquid, a superconducting magnet coil structure immersed within one of said volumes of cooling liquid, and cooling means for maintaining an operation temperature of the coil structure in the sub-helium temperature range, characterized in that said cooling means is a pulse tube refrigerator which extends into said first and second volumes of cooling liquid, wherein the means defining the first and second volumes of cooling liquid is a single bath having an internal separation means where the separation means is a thick thin-walled disk, or an evacuated disk, or a disk made of thermally low conducting material such as nylon or carbon fibre composites.

13. A cryostat system comprising means defining first and second volumes of a cooling liquid, a superconducting magnet coil structure immersed within one of said volumes of cooling liquid, and cooling means for maintaining an operation temperature of the coil structure in the sub-helium temperature range, characterized in that said cooling means is a pulse tube refrigerator which extends into said first and second volumes of cooling liquid in which the pulse tube refrigerator is used as a liquefier.

* * * * *